US007384529B1

(12) United States Patent
Ekechukwu

(10) Patent No.: US 7,384,529 B1
(45) Date of Patent: Jun. 10, 2008

(54) METHOD FOR ELECTROCHEMICAL DECONTAMINATION OF RADIOACTIVE METAL

(75) Inventor: Amy A. Ekechukwu, Augusta, GA (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 2169 days.

(21) Appl. No.: 09/672,046

(22) Filed: Sep. 29, 2000

(51) Int. Cl.
*G21F 9/28* (2006.01)

(52) U.S. Cl. ..... 205/43; 205/705; 205/717; 205/723; 205/771

(58) Field of Classification Search ..... 205/43, 205/705, 171, 723, 771
See application file for complete search history.

(56) References Cited

U.S. PATENT DOCUMENTS 3,873,362 A 3/1975 Mihram et al.
4,193,853 A 3/1980 Childs et al.
4,217,192 A 8/1980 Lerch et al.
4,481,089 A 11/1984 Izumida et al.
4,481,090 A 11/1984 Childs
4,537,666 A 8/1985 Murray et al.
4,615,776 A 10/1986 Sasaki et al.
4,663,085 A 5/1987 Enda et al.
5,102,511 A 4/1992 Suwa et al.
5,322,644 A 6/1994 Dunn et al.
5,340,505 A 8/1994 Hanulik et al.
5,439,562 A 8/1995 Snyder et al.
5,614,077 A 3/1997 Wittle et al.
6,214,189 B1 * 4/2001 Won et al. ..... 204/515

* cited by examiner

*Primary Examiner*—Arun S. Phasge
(74) *Attorney, Agent, or Firm*—Esther L. Roberts; Paul A. Gottlieb

(57) ABSTRACT

A decontamination method for stripping radionuclides from the surface of stainless steel or aluminum material comprising the steps of contacting the metal with a moderately acidic carbonate/bicarbonate electrolyte solution containing sodium or potassium ions and thereafter electrolytically removing the radionuclides from the surface of the metal whereby radionuclides are caused to be stripped off of the material without corrosion or etching of the material surface.

7 Claims, 1 Drawing Sheet

METHOD FOR ELECTROCHEMICAL DECONTAMINATION OF RADIOACTIVE METAL

GOVERNMENT RIGHTS

The United States Government has rights in this invention pursuant the terms of Department of Energy contract number DE-AC09-96SR18500.

FIELD OF THE INVENTION

The present invention relates to a method for decontamination of radioactive waste, and in particular, a method employing an electrolyte for decontamination of metals that have been contaminated by exposure to radioactive materials.

BACKGROUND OF THE INVENTION

Nuclear industry equipment and structural materials are subjected to radioactive contamination during use. The equipment, which is usually constructed from stainless steel or other metal, must therefore be routinely cleaned or otherwise treated to render it safe for further use or disposal. Such treatments include scrubbing, washing or abrading of the surface of the material in an effort to remove the deposits.

One such decontamination technology involves immersing the contaminated material in a carbonate solution and subjecting it to electrolysis sufficient to cause stripping or separating of the contaminants from the surface of the metal. Representative examples include the following U.S. patents; U.S. Pat. No. 3,873,362 to Mihram et al., U.S. Pat. No. 4,217,192 to Lerch et al., U.S. Pat. No. 4,537,666 to Murray et al., U.S. Pat. No. 4,663,085 to Edna et al., U.S. Pat. No. 5,102,511 to Suwa et al., U.S. Pat. No. 5,322,644 to Dunn et al. and U.S. Pat. No. 5,340,505 to Hanulik et al.

In each of the above cases, the chemical decontaminate comprises various acidic and/or alkaline reagents, with or without oxidizing agents. In these chemical-only decontamination methods, the electrolytic cell is employed solely for the purpose of regenerating the decontamination reagent. Accordingly, these methods do not teach use of the electrolytic cell as the primary mechanism for decontamination. Further, the reagents are in and of themselves hazardous or dangerous, particularly the acidic reagents. Finally, prior art acidic or alkaline reagents are destructive to the metal equipment being treated since they invariably erode or etch the surface of the metal during treatment.

Other prior art decontamination methods include the following:

U.S. Pat. No. 4,193,853 to Childs et al. teaches a metal decontamination system employing an electrolyte comprising nitrate salts, borate, fluoride or oxalate individually and at a basic pH. In a preferred embodiment, the electrolyte contains a combination of nitrate, borate, fluoride and oxalate ions and a pH between 7 and 11.

U.S. Pat. No. 4,481,089 to Izumida et al. teaches a metal decontamination system employing a neutral salt electrolyte with an alternating electrolysis method. Contamination is removed by applying a current to the electrochemical cell and at programmed intervals the current is reversed thereby causing loosening or shaking off of the contaminant from the surface of the metal. As is apparent, programmed current fluctuations requires the system be equipped with appropriate controls which adds to the cost of the system.

U.S. Pat. No. 4,481,090 to Childs teaches an improved system wherein a more efficient acidic electrolyte, which may include high concentrations of nitrate, is substituted for a prior art alkaline nitrate, borate, fluoride and oxalate electrolyte.

U.S. Pat. No. 4,615,776 to Sasaki et al. discloses an electrochemical metal decontamination method having a highly concentrated phosphoric acid solution for the electrolyte. The pH of the electrochemical cell is approximately 2.

U.S. Pat. No. 5,439,562 to Snyder et al. discloses a nickel recovery process employing electrochemical metal decontamination and in particular method a nickel recovery process directed toward removal of actinide radionuclides and technetium.

U.S. Pat. No. 5,614,077 to Wittle et al. discloses an electrochemical decontamination system including a reaction chamber where the pH and electrical current may be varied as required to precipitate out any radionuclide contamination. There is no disclosure of a specific electrolyte nor is contact provided between the anode or cathode and the item being decontaminated.

In view of the above, a need has existed in the art for a decontamination method that will not corrode or otherwise damage the metal equipment being treated thereby allowing the decontaminated equipment to be reused.

OBJECTS AND SUMMARY OF THE INVENTION

It is an object of the present invention to provide a method for decontaminating radioactive contaminated metal including application of a moderately acidic carbonate/bicarbonate electrolyte solution adapted to be non-corrosive to the metal being decontaminated.

Another object of the present invention is to provide a method for decontaminating metal contaminated by cesium, strontium or actinides, such as plutonium and uranium.

A further object of the present invention is to provide a method for decontaminating metal contaminated by radioactive materials that are strongly adhered to the surface of the metal and therefore cannot otherwise be removed by washing of the metal or the like.

Yet another object of the present invention is to provide a method for decontaminating metal that has been contaminated by radioactive material wherein following treatment the decontaminated metal may be rinsed and then properly disposed of or reused.

Yet another object of the present invention is to provide an efficient and economical method for decontaminating radioactive scrap metal to thereby reduce the disposal and storage costs normally associated with contaminated scrap metal.

A still further object of the present invention is to provide an electrolyte solution for decontaminating radioactive contaminated metals wherein following treatment, the electrolyte solution may be distilled to remove excess water and the remaining volume readily disposed of in an efficient and economical manner.

And another object of the present invention is to provide an electrolyte solution adapted to strip off radionuclides that have been plated or adhered to the surface of the metal being treated.

These and other objects are achieved by a decontamination method for removing radionuclides plated or otherwise adhered to the surface of stainless steel or aluminum materials, the method comprising the steps of contacting the metal with a moderately acidic carbonate/bicarbonate electrolyte solution containing sodium or potassium ions and thereafter electrolytically removing the radionuclides from the surface of the metal whereby radionuclides are caused to be stripped off of the material without corrosion of or etching to the material surface.

DETAILED DESCRIPTION OF THE PREFERRED EMBODIMENT

Figure 1:
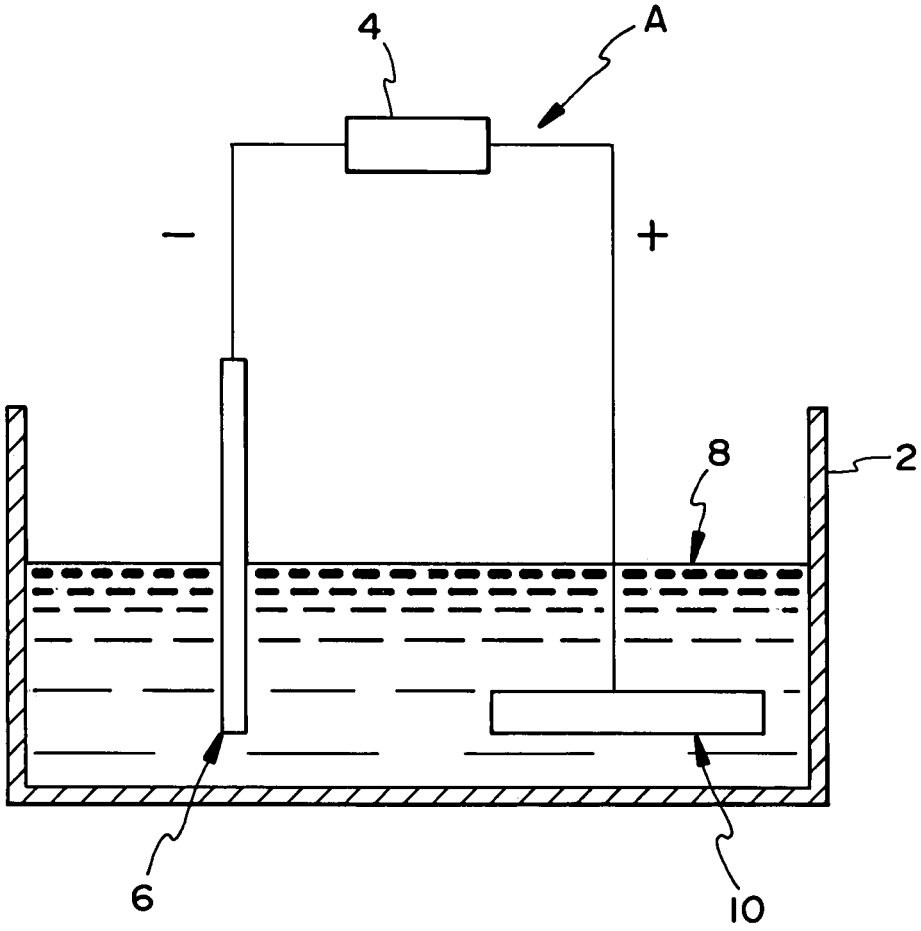
FIG. 1 is a schematic illustration showing the separation apparatus for use in accordance with the method of the present invention.

The method according to the present invention employs an acidic carbonate and/or bicarbonate electrolyte solution. The electrolyte solution promotes efficient and safe electrochemical stripping of radionuclides from the surface of a contaminated metal. The method is especially adapted for treatment of aluminum or stainless steel materials since they will not be damaged during electrolysis.

In the preferred embodiment, the electrolyte solution is moderately acidic i.e. having a pH of about 4, which renders the electrolyte uniquely non-corrosive to the stainless steel or aluminum metal being decontaminated. The electrolyte solution must readily provide the flow of free ions in solution during electrolysis sufficient to promote conduction of the applied current between the cathode and the anode while at the same time remove radionuclides without damage or corrosion to the surface of the material being decontaminated. Representative electrolyte solutions include, potassium or sodium carbonate and/or bicarbonate solutions having a moderately acidic pH of about 4. In embodiments employing carbonate and bicarbonate in the electrolyte, the carbonate concentration is preferably about 2% by weight of the bicarbonate in water.

FIG. 1 is a schematic diagram illustrating a separation apparatus A. As is apparent, it is within the scope of the present invention to modify the separation apparatus for commercial or other specific applications.

The apparatus A comprises a tank or vessel 2 appropriately adapted to receive and retain an electrolyte solution 8. A DC current power source 4 is provided, the power source including appropriate controls for regulating current density, voltage and the like. The power source 4 is electrically connected to a negative electrode or cathode 6 shown disposed in the interior of vessel 2 and shown immersed in the electrolyte. The positive electrode or anode comprises the object being decontaminated and is identified in the drawing as reference numeral 10. The object 10 is suspended in the tank 2 and electrically connected to the power source by appropriate means. The object 10 may comprise any of a variety of metals but is preferably constructed from stainless steel. Application of the DC current between the electrodes causes radionuclides attached to the surface of the anode; namely, cesium, strontium and actinides (such as plutonium and uranium) to be electrochemically stripped off of the metal object and into solution without damaging erosion of the metal surface. The decontaminated metal may then be rinsed and disposed of or reused, while the electrolyte solution containing the removed radionuclides disposed of as liquid waste or further distilled to concentrate the radioactive nuclides for further treatment or disposal.

While this invention has a preferred design that has been illustrated and described, it will be apparent to those skilled in the art that various changes, modifications or adaptations may be easily made without deviating from the scope of the invention or the limits of the claims appended hereto.

What is claimed is:

1. A method for removing radionuclides adhered to the surface of at least one of stainless steel or aluminum material, the method comprising the steps of:

a) contacting the material with a carbonate/bicarbonate electrolyte solution having a pH of about 4, the electrolyte solution containing at least one of sodium or potassium ions; and b) electrolytically removing the radionuclides from the surface of the metal whereby radionuclides are caused to be stripped off of the material without corrosion or etching to the material surface.

2. The method for removing radionuclides, as defined in claim 1, wherein the carbonate concentration is about 2% by weight of the bicarbonate.

3. The method for removing radionuclides, as defined in claim 1, wherein the radionuclides are selected from the group consisting of cesium, strontium and actinides.

4. A method for reclaiming radiation contaminated equipment constructed from at least one of stainless steel or aluminum material, the method comprising the steps of:

a) providing an electrolytic treatment vessel, the treatment vessel including a cathode and an electric current power supply for supplying DC current thereto;

b) providing an electrolytic solution within the treatment vessel, the electrolytic solution comprising a carbonate/bicarbonate solution having a pH of about 4 and containing at least one of sodium or potassium ions;

c) positioning equipment to be reclaimed in the tank and connecting the equipment to the power supply;

d) selectively applying a DC current between the cathode and the equipment for a period of time sufficient to cause electrolytic removal of radionuclides from the surface of the equipment whereby radionuclides are stripped off of the equipment without corrosion or etching to the surface of the equipment;

e) washing the equipment following electrolysis; and f) recovering the electrolytic solution for further treatment.

5. The method for reclaiming radiation contaminated equipment, as defined in claim 4, further including the step of distilling the recovered solution to separate the water from the stripped radionuclides.

6. The method for reclaiming radiation contaminated equipment, as defined in claim 4, wherein the carbonate concentration is about 2% by weight of the bicarbonate.

7. The method for reclaiming radiation contaminated a equipment, as defined in claim 4, wherein the radionuclides are selected from the group consisting of cesium, strontium and actinides.

* * * * *